US006776555B2

(12) United States Patent
Kuo

(10) Patent No.: US 6,776,555 B2
(45) Date of Patent: Aug. 17, 2004

(54) RETRO-REFLECTIVE PAVEMENT MARKER

(76) Inventor: Wen-Nan Kuo, P.O. Box 2-10, Tainan City (TW)

( * ) Notice: Subject to any disclaimer, the term of this patent is extended or adjusted under 35 U.S.C. 154(b) by 0 days.

(21) Appl. No.: 10/307,043

(22) Filed: Nov. 27, 2002

(65) Prior Publication Data

US 2004/0101364 A1 May 27, 2004

(51) Int. Cl.[7] ..... E01F 11/00
(52) U.S. Cl. ..... 404/16; 404/15
(58) Field of Search ..... 404/9, 15, 16; D10/113; 359/531

(56) References Cited

U.S. PATENT DOCUMENTS 3,427,933 A * 2/1969 Taylor-Myers ..... 404/9
3,971,623 A * 7/1976 Hedgewick et al. ..... 359/531
4,227,772 A * 10/1980 Heenan ..... 359/531
4,232,979 A * 11/1980 Johnson et al. ..... 404/16
4,595,312 A * 6/1986 Corless ..... 404/11
5,002,424 A * 3/1991 Hedgewick ..... 404/14
5,667,335 A * 9/1997 Khieu et al. ..... 404/14
6,126,360 A * 10/2000 May et al. ..... 404/14
6,168,276 B1 * 1/2001 Weid ..... 359/547
6,267,530 B1 * 7/2001 Attar ..... 404/16
D470,787 S * 2/2003 Kim ..... D10/113
6,579,036 B2 * 6/2003 Attar ..... 404/16
6,602,021 B1 * 8/2003 Kim ..... 404/16

FOREIGN PATENT DOCUMENTS

GB 2 120 711 * 5/1983

* cited by examiner

*Primary Examiner*—Gary S. Hartmann

(57) ABSTRACT

A retro-reflective pavement marker includes a body, a base and a plurality of retro-reflective members. The body has two recesses in two opposite sides for the retro-reflective members to fit therein from inside. Stuffing material is filled in a gap between the body and the base after the both are combined together, combining the body, the base and the retro-reflective members together to make up the retro-reflective pavement marker. The retro-reflective pavement marker is kept very stable on a road after a foot or feet of the base are implanted in the ground of a road.

3 Claims, 12 Drawing Sheets

(II–II)

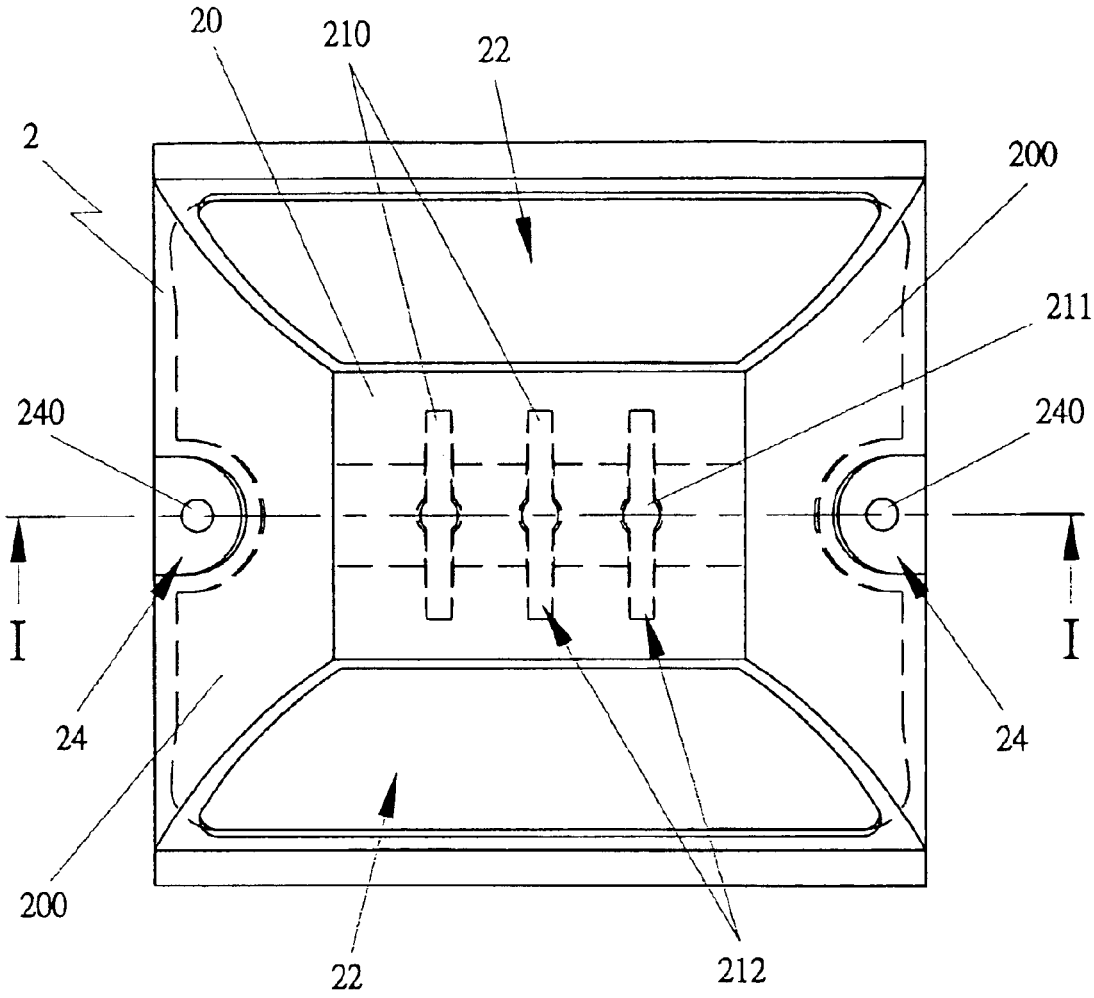
FIG 7
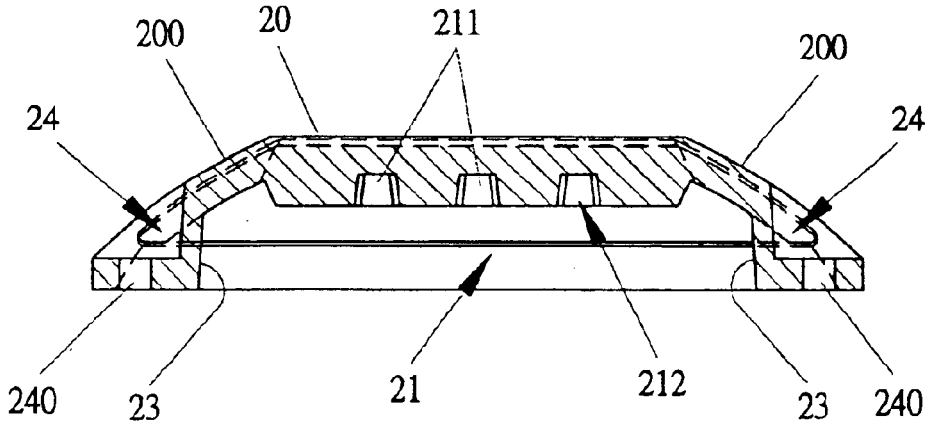
FIG 8 (I-I)

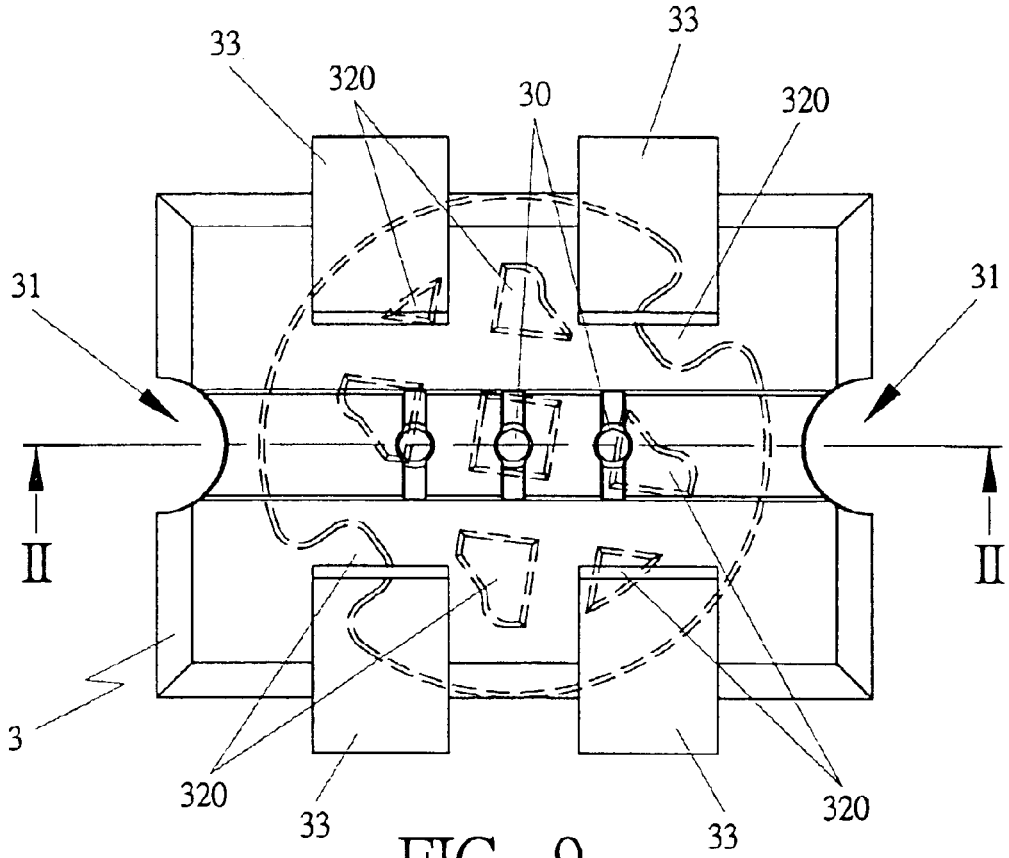
FIG 9
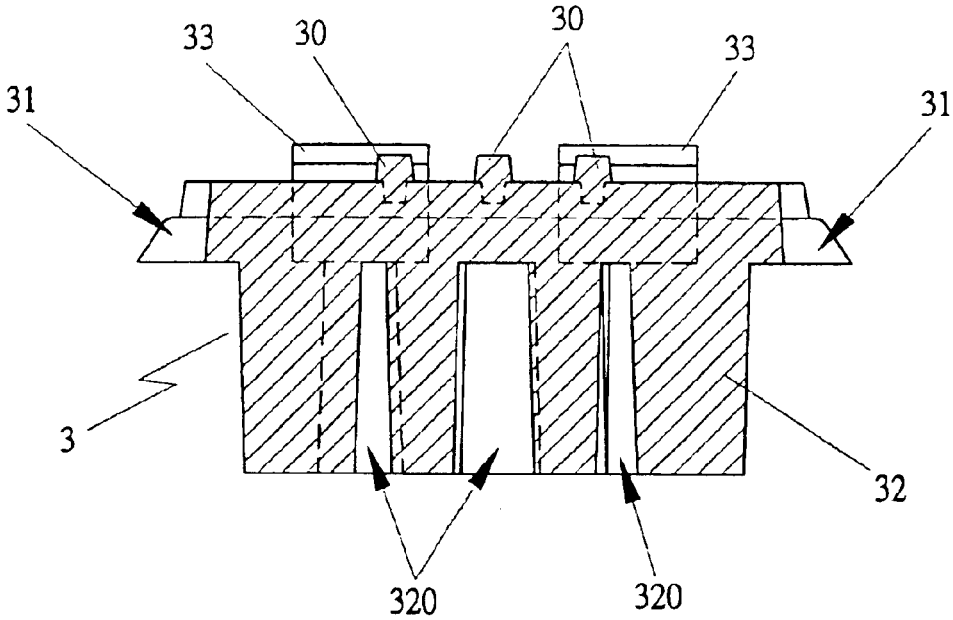
FIG 10 (II-II)

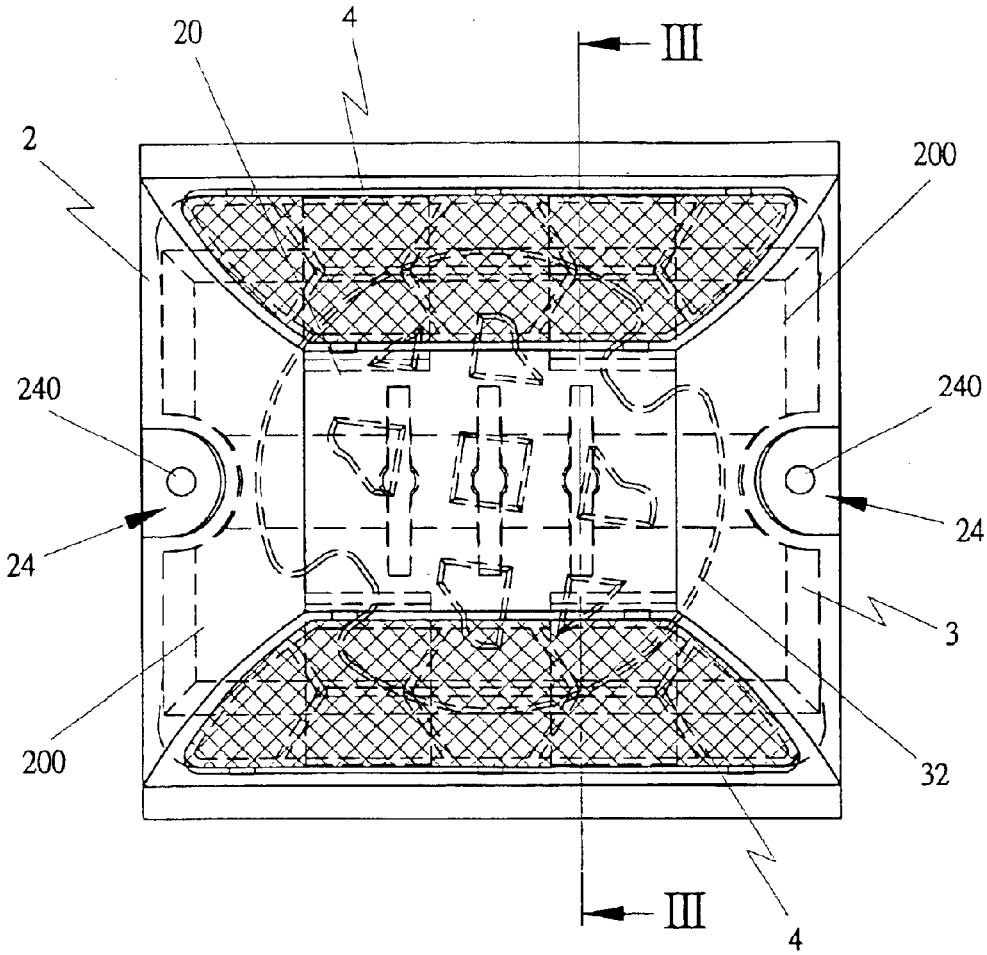
FIG 11
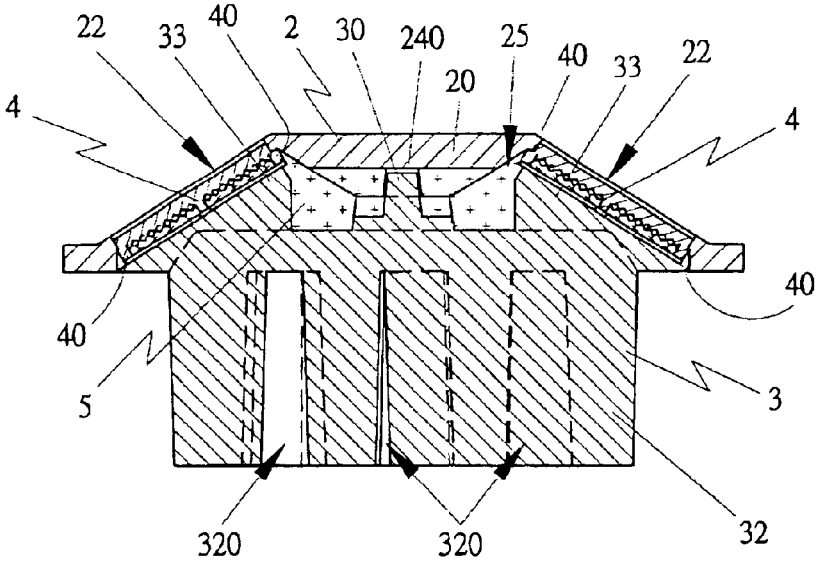
FIG 12 (III-III)

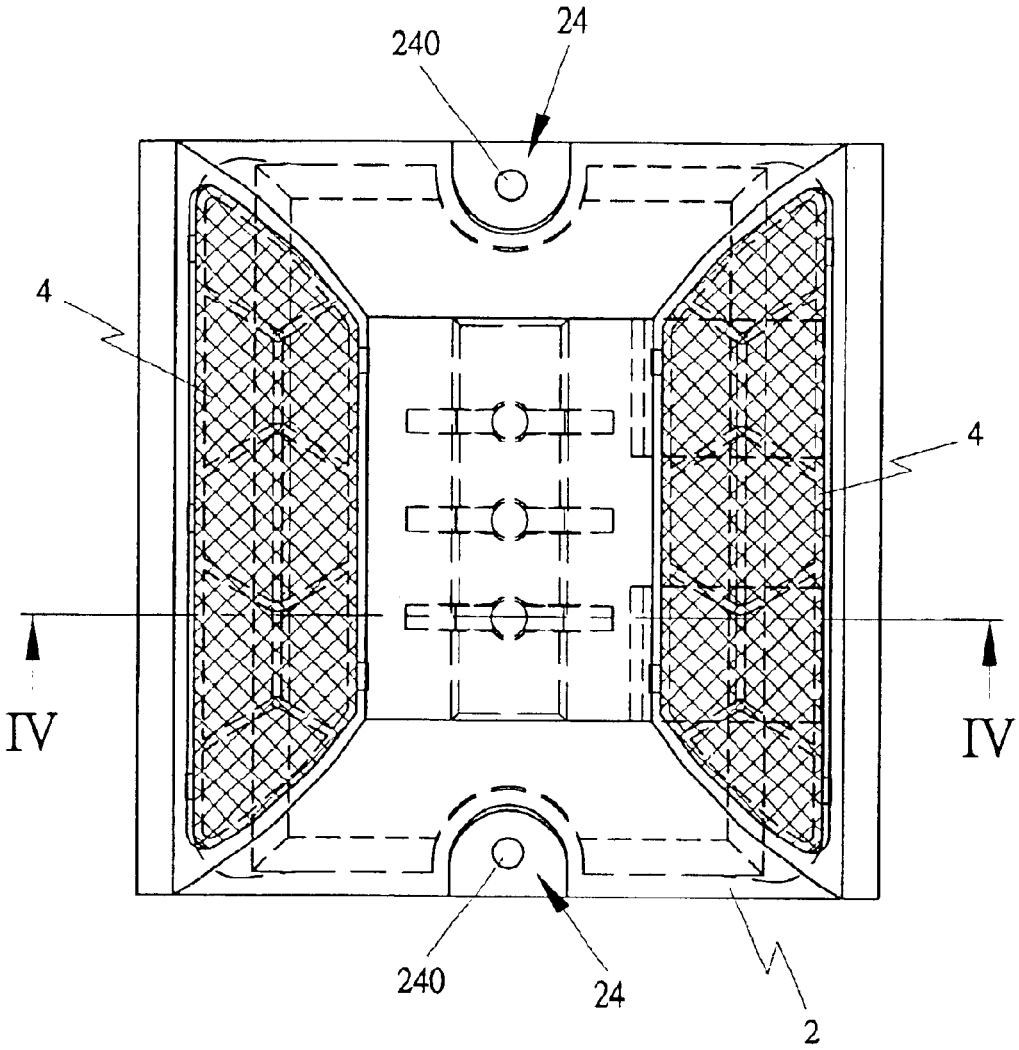
FIG 13
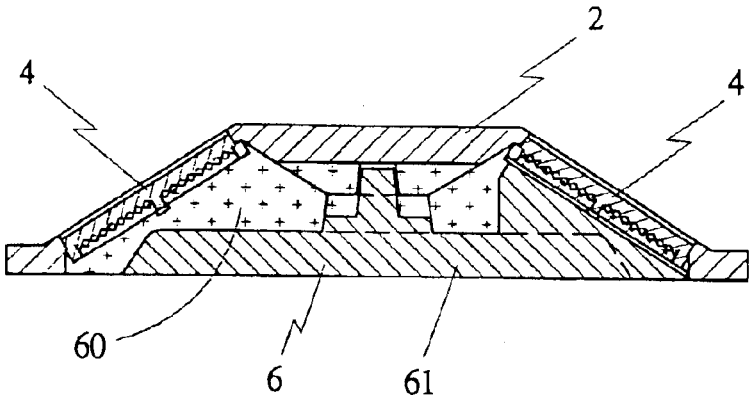
FIG 14 (IV-IV)

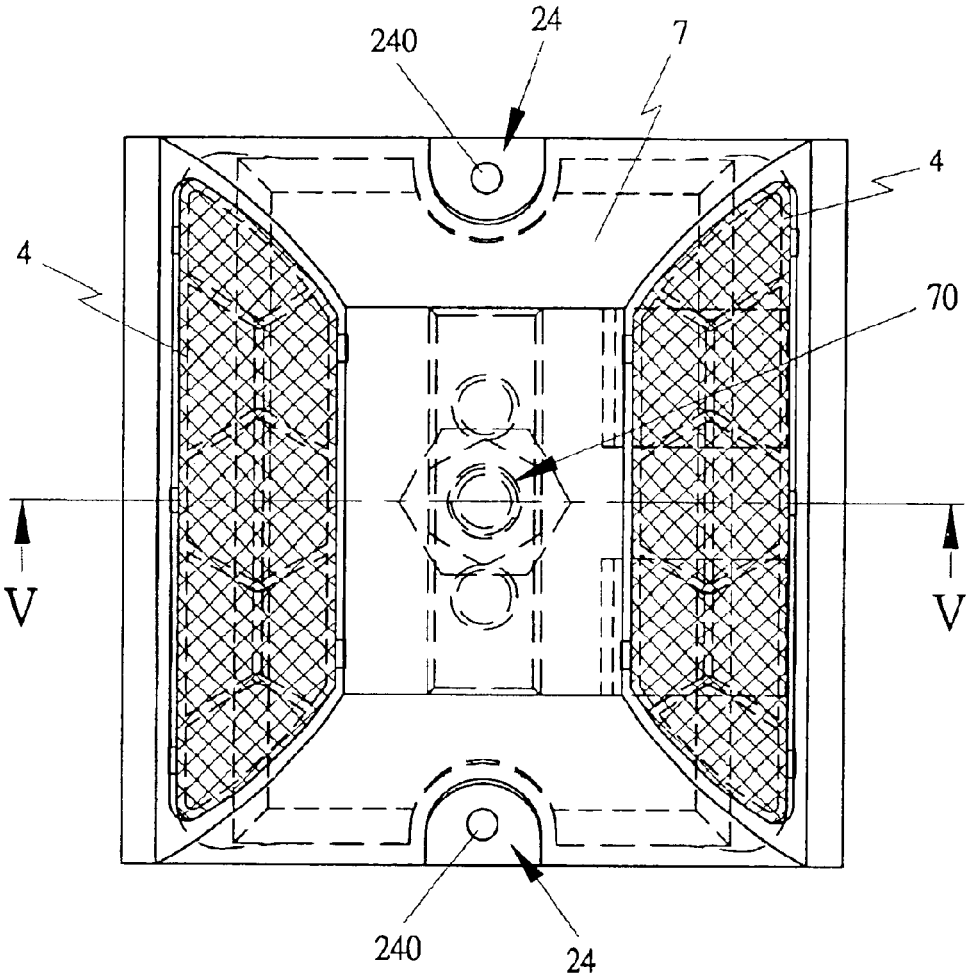
FIG 15
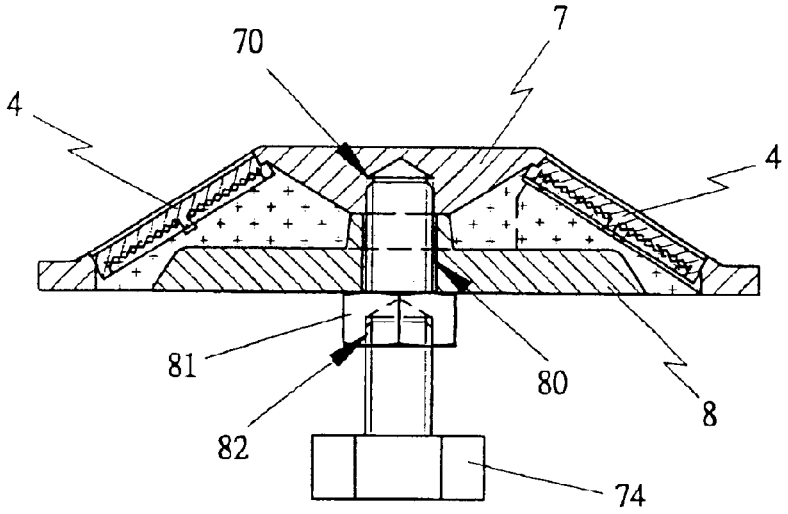
FIG 16 (V-V)

RETRO-REFLECTIVE PAVEMENT MARKER

BACKGROUND OF THE INVENTION

This invention relates to a retro-reflective pavement marker, especially to one having retro-reflective members hardly separating from a body kept positioned on a road stably for indicating branching of a road, A first conventional retro-reflective pavement marker shown in FIGS. 1–5 includes a body 1, and a post 10 made integral of zinc-aluminum alloy by means of casting, and a retro-reflective member 11 fitted from outside in a recess 12 respectively provided in two opposite sides of the body. A glue 13 is filled around the retro-reflective member 11 for adhere the retro-reflective members in the recesses 12 after the retro-reflective members are fitted in the recesses 12, combining the retro-reflective members 11 with the body 1.

However, the first conventional retro-reflective pavement marker has the body 1 and the post 10-formed integral to weigh heavy, resulting in a high cost. Further, the retro-reflective members 11 are liable to be compressed by vehicles running on a road to easily separate from and fall off the body 1 as they are glued only with the body 1, after the retro-reflective pavement marker is fixed on a branching line of a road.

Next, the body 1 has a bottom surface 15 formed with a plurality of holes 16 closely spaced apart, so when the retro-reflective pavement marker is fixed on a soft asphalt or tar road surface, it receives the heavy weight of many vehicles so that the road surface may be pressed down in the holes 16 to get a little destroyed or to force the retro-reflective pavement marker decline.

Further, the inner surfaces 110 of the retro-reflective members 11 are smooth and glossy, and stuffing material 14 such as epoxy filled around and under the retro-reflective members 11 to adhere them with the body 1. But the retro-reflective members 11 are only kept combined with the body 1 with their bottom surfaces by the stuffing material 14, so they are quite liable to separate from and fall off the body 1 or get broken because of compression of the wheels of heavy-duty vehicles running on a road, Another disadvantage of the conventional retro-reflective member is that it can endure only a comparatively light weight as it has only one region of its inner surface glued with the stuffing material 14, impossible to endure the compressing weight of heavy-duty vehicles.

SUMMARY OF THE INVENTION

This invention has been devised to offer a retro-reflective pavement marker provided with retro-reflexive members hardly separating from a body, possible to endure heavy weight of heavy-duty vehicles for indicating branching of a road.

One feature of the invention is that this retro-reflective pavement marker includes a body, a base and retro-reflective members. The body has a base cavity for receiving a base and recesses for receiving from inside retro-reflective members therein. Then stuffing material such as epoxy is filled around and under the retro-reflective members fitted in the recesses for combining the body, the bases and the retro-reflective members together integrally.

Another feature of the invention is the recesses receiving the retro-reflective members therein from the inside instead of from the outside of the recesses so as to prevent the retro-reflective members from separating from or falling off the body.

BRIEF DESCRIPTION OF DRAWINGS

This invention will be better understood by referring the accompanying drawings, wherein:

FIG. 7 is an upper view of a first embodiment of a retro-reflective pavement marker in the present invention;

FIG. 8 is a cross-sectional view of the line I—I in FIG. 7;

FIG. 9 is an upper view of the first embodiment of a retro-reflective pavement marker in the present invention;

FIG. 10 is a cross-sectional view of the line II—II in FIG. 9;

FIG. 11 is an upper and cross-sectional view of the first embodiment in the present invention;

FIG. 12 is a cross-sectional view of the line III—III in FIG. 11;

FIG. 13 is an upper view of a second embodiment of a retro-reflective pavement marker in the present invention;

FIG. 14 is a cross-sectional view of the second embodiment of a retro-reflective pavement marker in the present invention;

FIG. 15 is an upper view of a third embodiment of a retro-reflective pavement marker in the present invention;

FIG. 16 is a cross-sectional view of the line V—V in FIG. 15;

DETAILED DESCRIPTION OF THE PREFERRED EMBODIMENT

Figure 1:
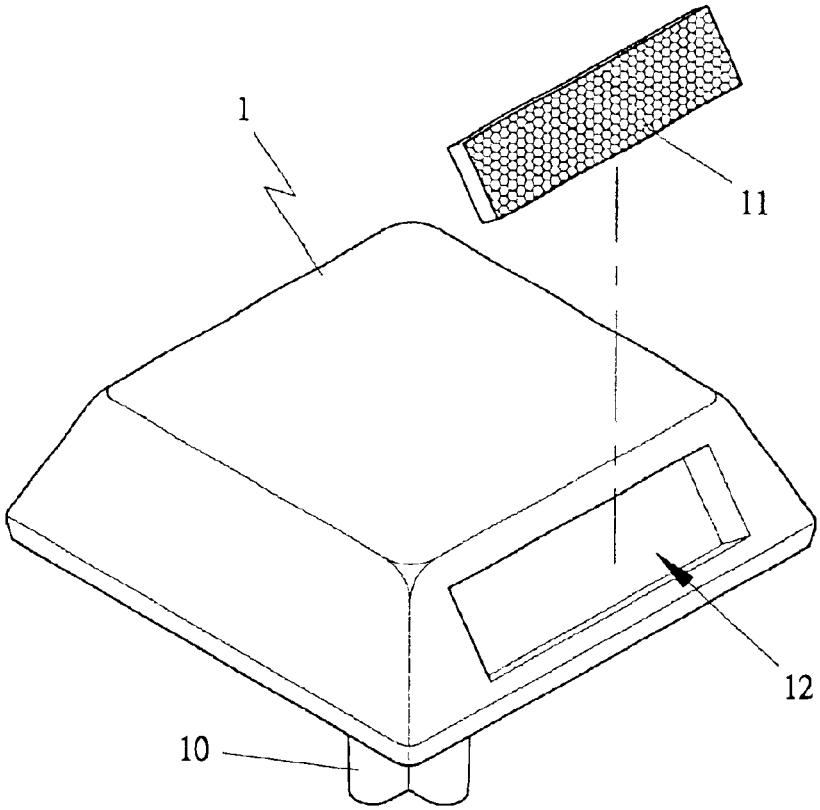
FIG 1 (PRIOR ART)
FIG. 1 is an exploded perspective view of a first conventional retro-reflective pavement marker.
Figure 2:
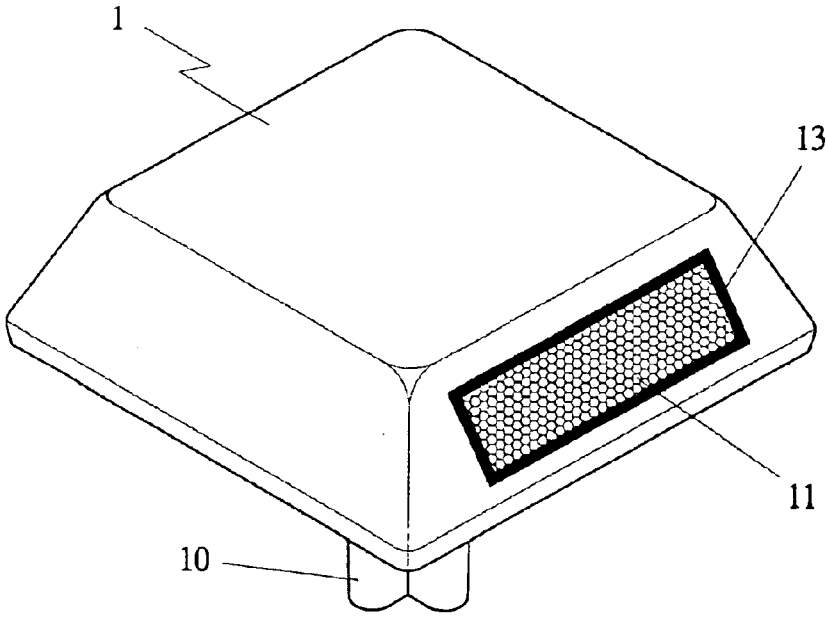
FIG 2 (PRIOR ART)
FIG. 2 is a perspective view of the first conventional retro-reflective pavement marker.
Figure 3:
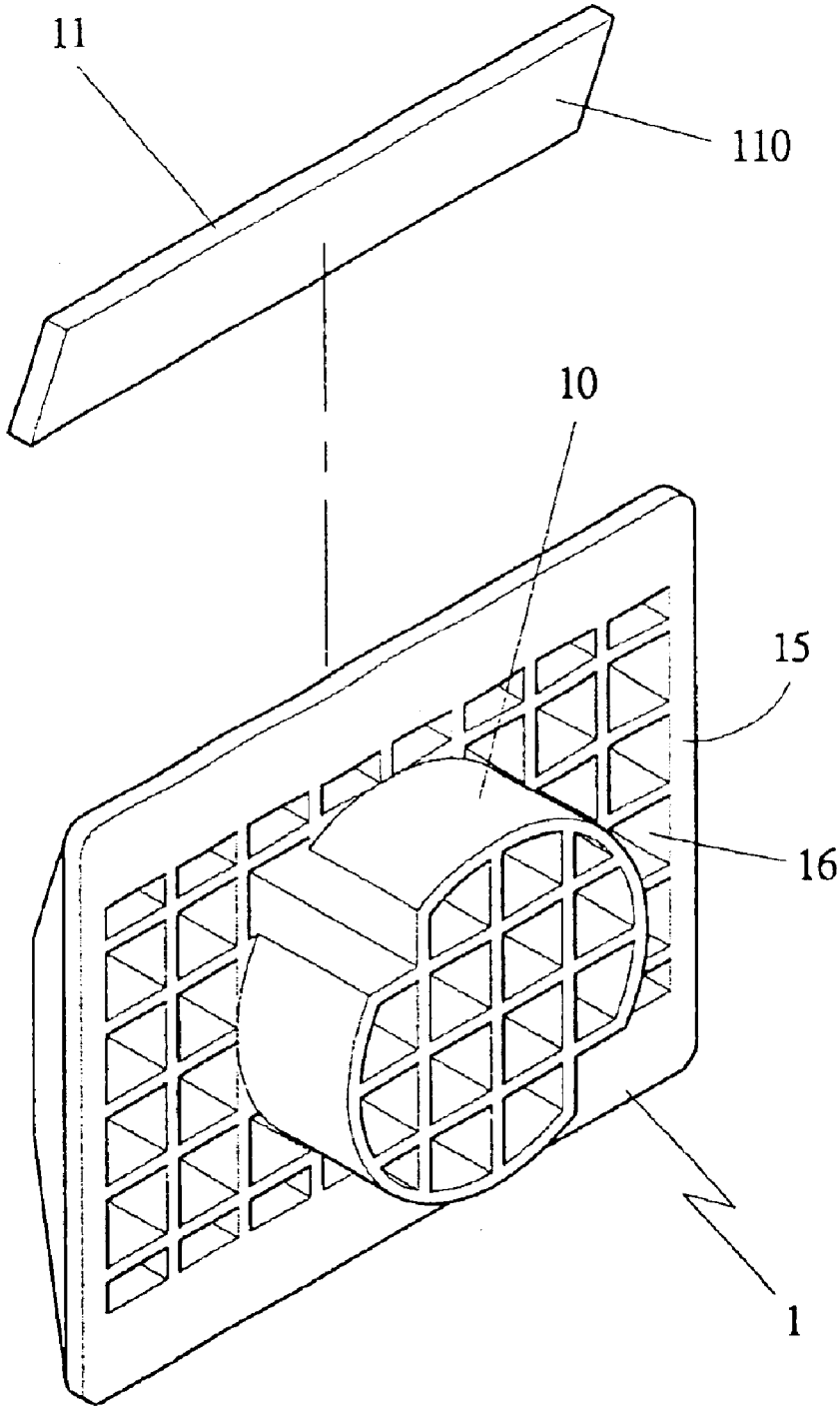
FIG 3 (PRIOR ART)
FIG. 3 is an exploded perspective view of a second conventional retro-reflective pavement marker.

A first embodiment of a retro-reflective pavement marker in the present invention, as shown in FIGS. 7–12, includes a body 2 (shown in FIGS. 7 and 8), a base 2 (shown in FIGS., 9 and 10) and a plurality of retro-reflective members 4 as main components combined together.

The body 2 has an upper surface 20, two opposite side sloped surfaces 200 extending from the upper surface 20, a base cavity 21 formed in a lower portion for the base 2 fit therein from below, a plurality of position holes 210 spaced apart regularly in a lower wall of the upper surface 20 and respectively consisting of a post hole 211 and an elongate slot 212 to conform to the shape of the base 3, a side curved surface 23 respectively defining two opposite sides of the base cavity 21 for the base 3 to fit and combine with the body 2 accurately, and two opposite recesses 22 abutting with the two sloped surfaces 200. Further, a grip recess 24 is formed in an outer surface of the wall defining the side curved surface 23 for a user's finger to fit therein to catch hold of the retro-reflective pavement marker in carrying the retro-reflective pavement marker. Each grip recess 24 has a hole 240 for a stud bolt to insert through to be implanted in the ground, and a glue around the stud bolt may spread upward through the hole 240 to reach the road surface so as to fixing the retro-reflective pavement marker firmly enough on the road.

The base 3 is also made of zinc-aluminum alloy through casting, having a plurality of posts 30 formed spaced apart in an upper portion for fitting in the post holes 211 of the position holes 210. The base 3 further has a semicircular recess 31 respectively at two opposite sides to match with the side basis curved surface 23 so as to combine the body 2 with the base 3 correctly. In addition, the base 3 has a plurality of feet 32 spaced apart and extending down vertically and a vertical gaps 320 formed between every two feet 320, so the feet 32 may be implanted in the ground with all the gaps 320 filled with material of the road such as concrete, asphalt or tar, keeping the retro-reflective pavement marker hardly separate from the road. The base 3 further has a plurality of push members 33 formed on the feet 32 to contact a bottom surface and a lower side surface of each retro-reflective members 4 to keep the same members 4 in place before stuffing material 5 is filled around and under the same members 4 and fix firmly enough the same members 4 after the stuffing material 5 is filled in.

Each retro-reflective member 4 is combined with the body 2 by being fitted in the two opposite recesses 22 of the body 2. As shown in FIGS. 11 and 12, the base 3 is combined with the body 2 by means of stuffing material 5 (such as epoxy) filled in an empty gap 25 between the base 3 and the body 2 so that the body 2, the base 3 and the retro-reflective members 4 are combined together firmly enough, having an advantages of light weight and uneasily falling-off of the retro-reflective members 4 from the body 2.

Next, FIGS. 13 and 14 show a second embodiment of a retro-reflective pavement marker, which has a body 2, a case 6 and a plurality of retro-reflexive members 4. The body 2 and the retro-reflective members 4 are of the same structure as the first embodiment, and the providing way of the body 2 and the combining way of the body and the base 6 are all the same as the first embodiment. But the base 56 is different form that of the first embodiment, having no feet 3 in the base 3, so the second embodiment does not need to implant the base in the ground, having a rough and coarse surface on the bottom surface 61 so as to attach closely and tightly on a road surface.

In addition, FIGS. 15 and 16 show a third embodiment of a retro-reflective pavement marker in the invention, having a body 7, a base 8 and a plurality of retro-reflective members 4. The combining way of the body 7 and the retro-reflective members 4 is the same as the first embodiment, but the body 7 has an inner center threaded hole 70 for combining with the base 8, The base 8 has a threaded hole 80 for a bolt 81 to engage and further with the inner center threaded hole 70 of the body 7, and then the head 82 of the bolt 81 pushes against the bottom surface of the base 8. Further, another bolt 74 is used to form a foot of the base 8 to fitting in the bolt head 82 and then implanted in the ground to prevent the retro-reflective pavement marker from loosening off the road surface. The third embodiment has an advantage of easy combination of the body 7 and the base 8 by means of a bolt.

Figure 17:
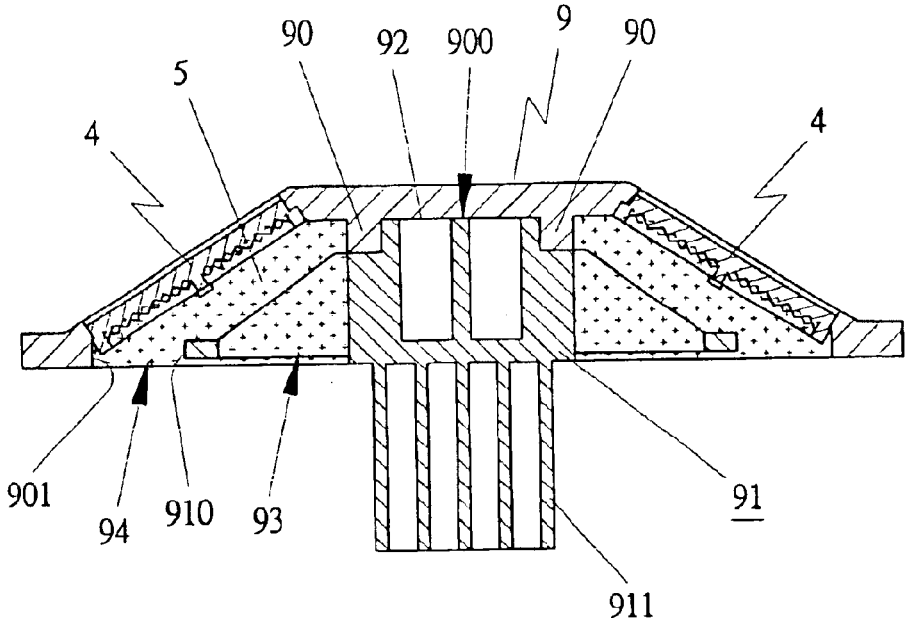
FIG. 17 is a cross-sectional view of a fourth embodiment of an retro-reflective pavement marker in the present invention.
Figure 18:
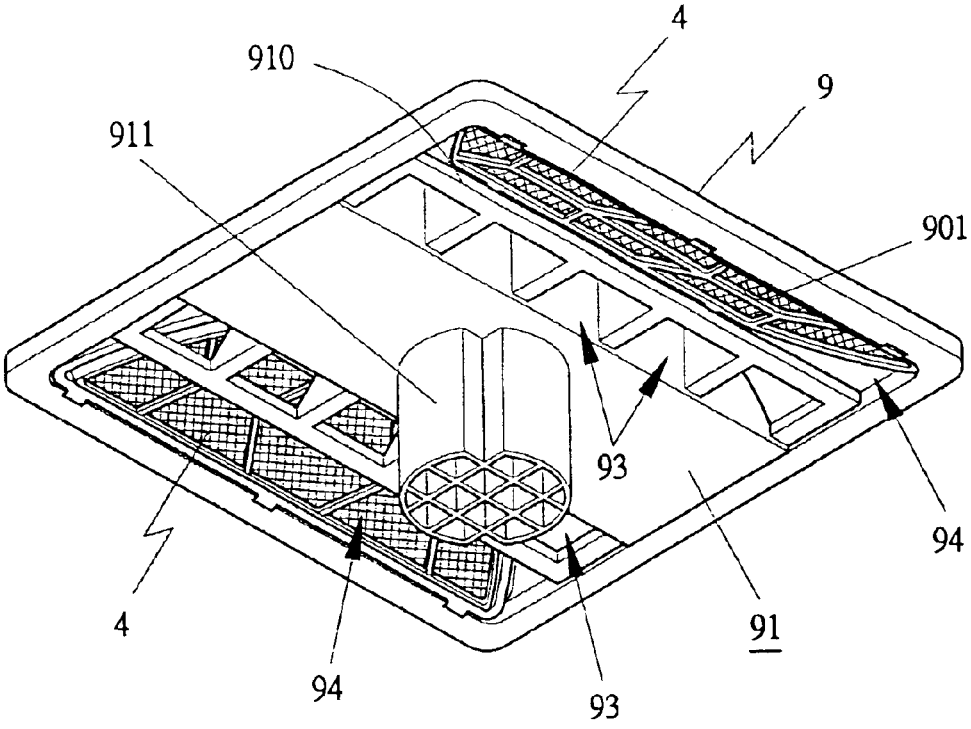
FIG. 18 is a perspective view of the fourth embodiment of a retro-reflective pavement marker in the present invention.
Figure 19:
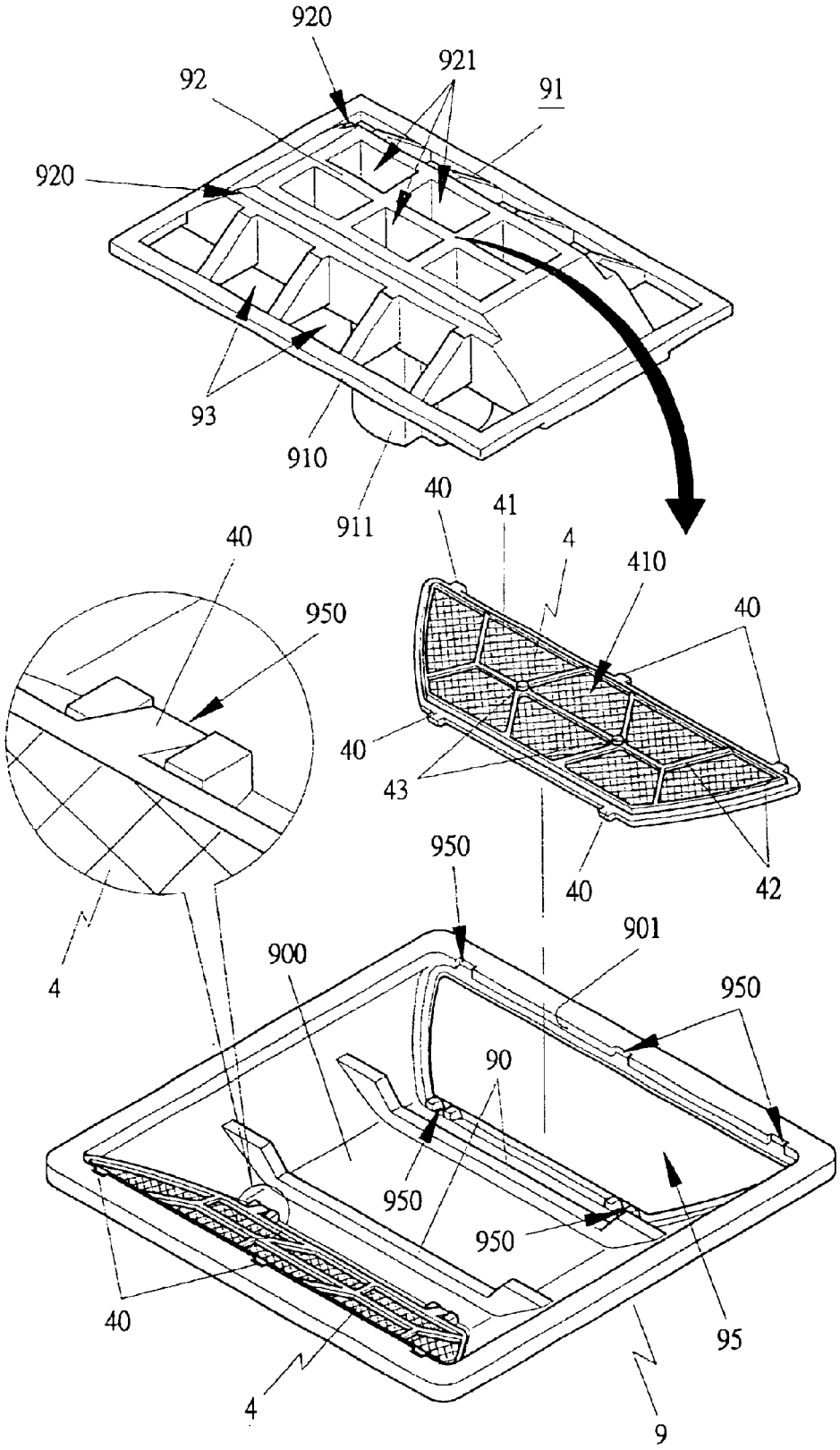
FIG. 19 is an exploded perspective view of the fourth embodiment of an retro-reflective pavement marker in the present invention; and, FIG. 20 is a perspective view of another embodiment of a retro-reflective member in the present invention.
Figure 20:
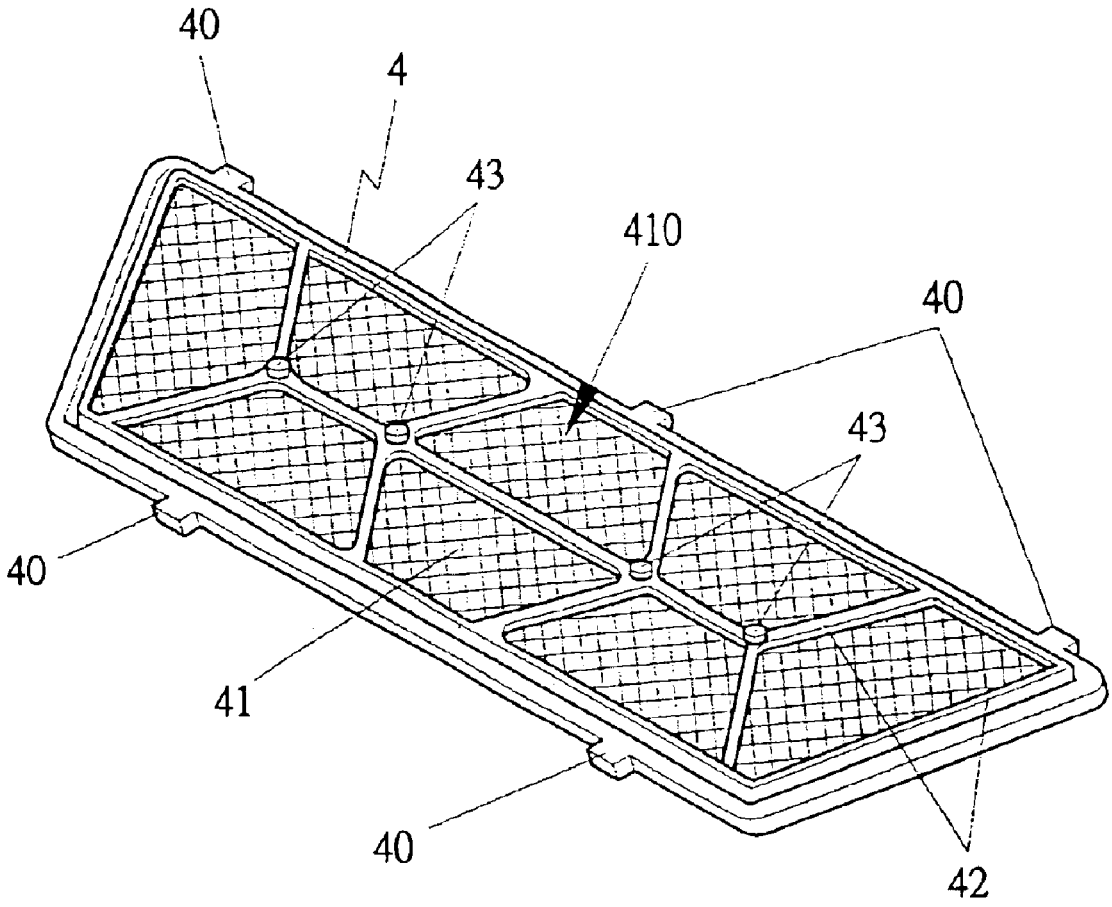

Further, FIGS. 17, 18 and 19 show a fourth embodiment of a retro-reflective pavement marker in the invention, which includes a body 9, a base 91, and a plurality of retro-reflective members 4. The body 9 has two parallel ridges 90 on an inner wall, and the base 91 has two grooves 920 in a bottom surface 92 to match with the two parallel ridges 90 of the body 9, and the bottom surface 92 supports the inner wall 900 of the body 9 in order to increase endurable weight of the retro-reflective pavement marker. Further, the bottom surface 92 of the base 91 has a plurality of holes 921, whose number may be depended on the weight it needs to endure. Or the bottom surface of the base 9 is made solid without the holes 921, possible to endure rolling-over of heavy-duty vehicles, not causing falling-off or getting out-of-order of the retro-reflective members 4. The body 9 further has two opposite recesses 95, and a plurality of fitting grooves 950 along the recesses 95. The base 91 has a plurality of holes 93 so that after the base 91 is combined with the body 9, the side edge 910 of the base 91 and the side edge 901 of the body 9 make up a gap 25. Then when stuffing material is filled in the gap 25 between the body 9 and the base 91, the body 9 and the base 91 may be combined together stably. And then the feet 911 of the base 91 are implanted in the ground conveniently to elevate the practical value of the retro-reflexive pavement marker.

Figure 4:
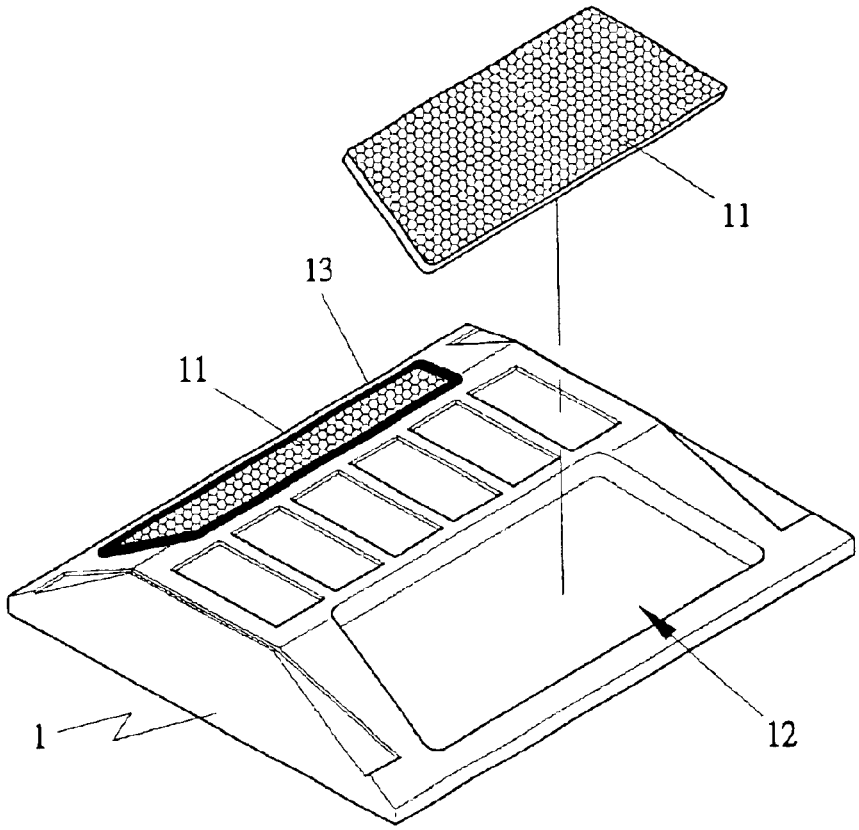
FIG 4 (PRIOR ART)
FIG. 4 is an exploded perspective view of a third conventional retro-reflective pavement marker.
Figure 5:
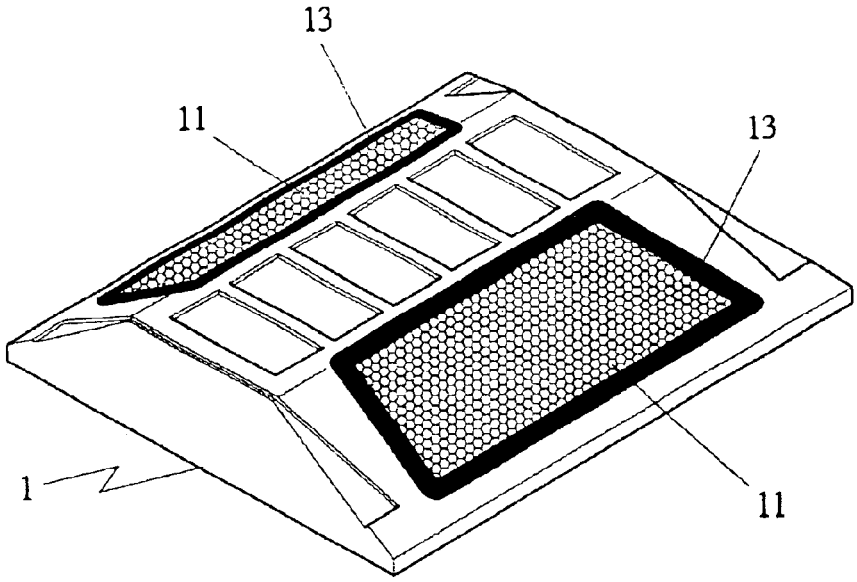
FIG 5 (PRIOR ART)
FIG. 5 is a perspective view of the third conventional retro-reflective pavement marker.
Figure 6:
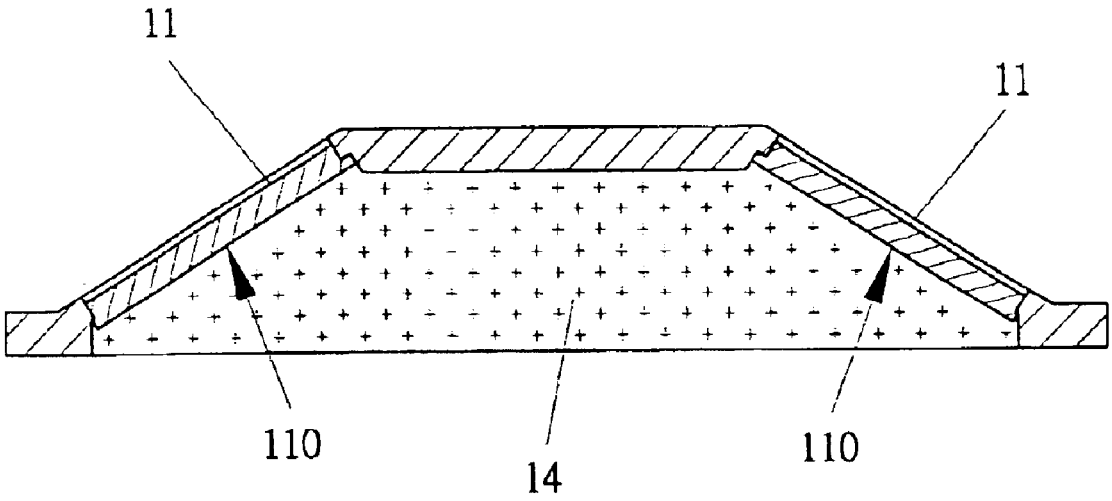
FIG 6 (PRIOR ART)
FIG. 6 is a cross-sectional view of the third conventional retro-reflective pavement marker.

The retro-reflective member 4 used in all the embodiments of the invention generally has a plurality of projections 40 around its circumference, for example with FIG. 4, and the projections 40 are fitted in the grooves 950 of the body 9, combining the retro-reflective members 4 with the body. If the retro-reflective members 4 and the body 9 are all made of plastics, the both may be combined together by fusing the projections 40 with the grooves 95 by means of the high frequency process, but if the body is made of zinc aluminum alloy, instant glue may be used for combining them together. This process can eliminate flaws such as falling-off or slanting of the retro-reflective members possibly caused before stuffing material is filled in the gap between the body and the base. Further the retro-reflective members 4 are respectively provided with a retro-reflecting surface 41 made of many cone-shaped grains 410 for increasing reflective effectiveness of light, and a plurality of ribs 42 dividing the retro-reflecting surface 41 and upright projections 43 at connecting points of the ribs 42 for firm combination of the stuffing material filled in. This structure can stabilize assembly of the body and the retro-reflective members in such a way that the retro-reflective pavement marker may endure rolling-over of heavy-duty vehicles running on a road, with the plural sections of the retro-reflecting surface independently enduring weight of heavy-duty trucks, trailers, etc. in addition to the functions of uneasy rupture, prevention for water flowing, and light reflecting purpose.

In general, the body in the invention may be combined with a base made of either plastics or zinc aluminum alloy, or not using a base but directly filling stuffing material 5 (such as epoxy) in the body for various necessities of roads. Besides, the body is solid, having a comparatively excellent pressure-resisting characteristic and reduced shrinkage, a decent appearance, firmness to resist rupture by rolling-over of wheels of heavy-duty vehicles, long durability, and waterproof property.

While the preferred embodiments of the invention have been described above, it will be recognized and understood that various modifications may be made therein and the appended claims are intended to cover all such modifications that may fall within the spirit and scope of the invention.

What is claimed is:

1. A retro-reflective pavement marker comprising:

a body having a top wall, two opposite sloping-down side walls extending from said top wall, a base cavity defined by said top wall and said two opposite sloping-down side walls and formed in a lower portion of said body for a base to fit therein, a plurality of parallel position holes spaced apart in said top wall, each said position hole respectively having a long slot and a post hole in the center of said long slot to match with the shape of said base, two opposite recesses formed to abut said two sloping-down side walls for receiving respectively a retro-reflectively member therein, said base cavity having a curved potion respectively on said two sloping-down side walls;

said base having a plurality of posts extending upward and spaced apart to fit in said post holes of said position holes of said body, a recess formed respectively in two opposite sides of said base to match with said curved portion of said base cavity of said body, a plurality of feet spaced apart by a gap separating every two of said feet, a plurality of push members provided on said feet and contacting a bottom surface and a lower side surface of each retro-reflective member; and, said retro-reflective members respectively fitting in each of said two opposite recesses of said body, stuffing material filled in a hollow space formed between said body and said base.

2. The retro-reflective pavement marker as claimed in claim 1, wherein said body has a threaded hole in said top wall, and said base also has a threaded hole for a first bolt to engage therein and further in said threaded hole of said body, a second bolt engages with a head of said first bolt and functions as a foot of said base.

3. A retro-reflective pavement marker comprising:

a body having a top wall, two opposite side walls extending down from said top wall, two parallel ridges formed on an inner surface of said top wall, two opposite recesses for two retro-reflective members to fit therein, and a plurality of engaging grooves formed around a circumference of each said recess;

a base having two parallel grooves to engage with said two parallel ridges of said body, a plurality of holes coupled to a gap between a side edge of said base and a side edge of said body after said base is combined with said body so that stuffing material may easily flow into said gap, and a plurality of feet formed to extend down for being implanted in the ground of a road;

a plurality of retro-reflective members respectively having a post and fitting in said recesses of said body, a retro-reflecting surface formed with many cone-shaped grains to enable said retro-reflecting surface in reflect light, a plurality of ribs formed on said retro-reflecting surface for dividing said retro-reflecting surface into plural sections, said ribs also forming solid combination of stuffing material filled in said gap between said body and said base; and, said body, said base and said retro-reflective members combined to form said retro-reflective pavement marker after said stuffing material is filled in said gap between said body and said base.

* * * * *